US006317978B2

(12) United States Patent
Reiter

(10) Patent No.: US 6,317,978 B2
(45) **Date of Patent: *Nov. 20, 2001**

(54) ELECTROMAGNETICALLY ACTUATED VALVE

(75) Inventor: Ferdinand Reiter, Markgröningen (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/254,898

(22) PCT Filed: Mar. 26, 1998

(86) PCT No.: PCT/DE98/00885

§ 371 Date: Mar. 12, 1999

§ 102(e) Date: Mar. 12, 1999

(87) PCT Pub. No.: WO99/04158

PCT Pub. Date: Jan. 28, 1999

(30) Foreign Application Priority Data

Jul. 15, 1997 (DE) ..... 199 30 202

(51) Int. Cl.[7] ..... F02M 51/06; F02M 61/16

(52) U.S. Cl. ..... 29/890.13; 251/129.21

(58) Field of Search ..... 251/129.21, 129.15; 239/585.1; 29/890.126, 890.13

(56) References Cited

U.S. PATENT DOCUMENTS

| | | | | |
|---|---|---|---|---|
| 4,915,350 | * | 4/1990 | Babitzka et al. | 251/129.21 X |
| 4,946,132 | * | 8/1990 | Reiter | 251/129.21 |
| 5,178,362 | * | 1/1993 | Vogt et al. | 251/585.1 X |
| 5,199,648 | * | 4/1993 | Fujikawa | 251/129.21 X |
| 5,360,197 | * | 11/1994 | Reiter et al. | 251/129.21 |
| 5,566,920 | * | 10/1996 | Romann et al. | 251/129.21 |
| 5,649,360 | * | 7/1997 | Schwarz | 29/890.13 |
| 5,875,975 | * | 3/1999 | Reiter et al. | 251/585.1 |
| 5,927,613 | * | 7/1999 | Koyanagi et al. | 251/129.21 X |
| 6,012,701 | * | 1/2000 | Reiter | 251/129.21 |

FOREIGN PATENT DOCUMENTS

| | | |
|---|---|---|
| 38 31 196 | 3/1990 | (DE) . |
| 40 08 675 | 9/1991 | (DE) . |
| 44 26 006 | 1/1996 | (DE) . |

* cited by examiner

*Primary Examiner*—Kevin Shaver
*Assistant Examiner*—John Bastianelli
(74) *Attorney, Agent, or Firm*—Kenyon & Kenyon

(57) ABSTRACT

An electromagnetically actuated valve is provided having that an axially movable valve needle, which is formed by an armature, a valve closing body and a connection piece connecting the two. The tubular connection piece has two elongated slots, which do not extend over the entire length of the connection piece, but at least over 75% of its length. Thus there are two spring-elastic half-shells in the slotted area. The valve closing body is attached at the unslotted end of the connection piece. The valve is particularly well suited for use in fuel injection systems of compressed-mixture, externally ignited internal combustion engines.

8 Claims, 2 Drawing Sheets

ELECTROMAGNETICALLY ACTUATED VALVE

FIELD OF THE INVENTION

The present invention relates to an electromagnetically actuated valve.

BACKGROUND INFORMATION

German Patent no. 38 31 196 describes an electromagnetically actuated valve, which has a valve needle axially movable in a through bore of a valve seat support. The valve needle is formed by a cylindrical armature, a spherical valve closing body and a tubular or sleeve-shaped connection piece that connects those two components. The connection piece is made of a flat metal sheet that is subsequently rolled or bent until it assumes a cylindrical, sleeve-like shape. In this form, the connection piece has a slot extending over its entire axial length, which may run parallel or at an angle to the longitudinal valve axis. The two longitudinal end faces of the metal sheets used oppose one another, forming a constant-width slot between them.

German Application no. 40 08 675 describes an electromagnetically actuated valve, in which the valve closing body is attached to the connection piece with a welding seam, which is interrupted at least in the area of the longitudinal slot or also at other points in the peripheral direction.

SUMMARY OF THE INVENTION

The electromagnetically actuated valve according to the present invention has the advantage that it can be manufactured cost-effectively in a particularly simple manner due to the advantage of a connection piece with relatively great tolerances. Having light weight and high stability, the connection piece has a large hydraulic flow cross section area. Due to the fact that the slot extends over a large part of its axial length, the connection piece is spring-elastic at one end, which facilitates the connection to the armature. Due to its spring-like flexibility, the connection piece can be inserted in the inner opening of the armature with both of its half-shells under stress, so that the disadvantageous formation of chips during the assembly of the armature is avoided. On the other hand, the valve closing body can be attached to the unslotted end of the connection piece in a very simple and reliable manner without bridging slots. The slots of the connection piece made of a non-magnetic material prevent the formation of undesirable eddy currents.

It is particularly advantageous if the connection piece is made of a metal sheet by first punching and subsequently deep drawing sheet sections in a "wristwatch" shape. When deep drawing the sheet section, two sheet tabs that are formed are bent so that two half-shells with a semicircular cross section are obtained, the slot being formed by the long end faces of the two sheet tabs opposing one another with a short distance between them.

In an advantageous manner, the rigid attachment of the valve closing body, which is spherical, for example, can be achieved using a welding seam over the entire 360° periphery of the connection piece at its unslotted, non-elastic end, which has a very high dynamic strength due to its full contact with the connection piece. The advantage is the simple and reliable manner the components can be handled when the welding seam is applied, which has no interruptions due to the peripheral end of the connection piece and is also very homogeneous.

DETAILED DESCRIPTION

Figure 1:
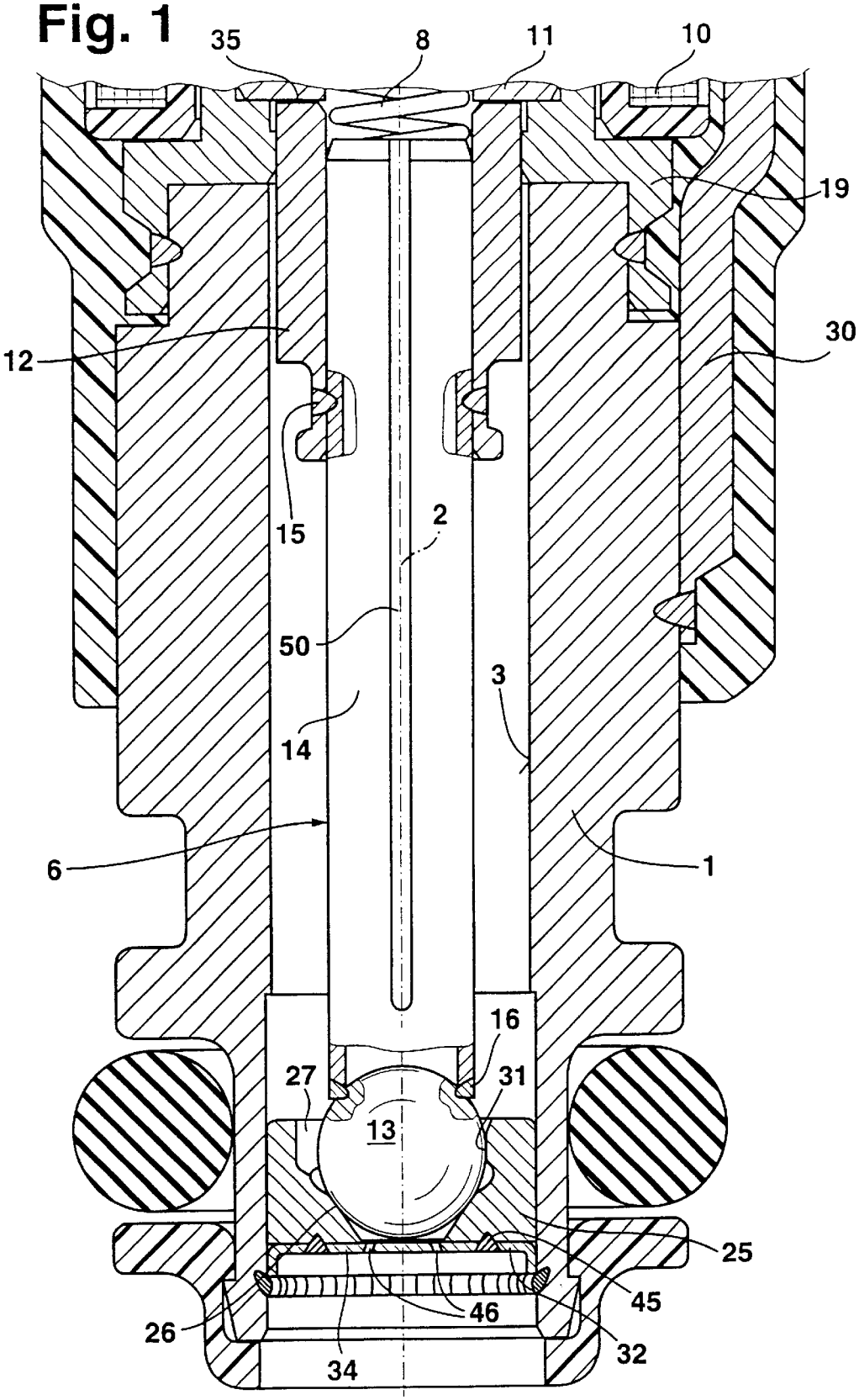
FIG. 1 shows a partial view of an electromagnetically actuated valve.

FIG. 1 partially shows an embodiment of an electromagnetically actuated valve in the form of an injection valve for fuel injection systems of compressed mixture externally ignited internal combustion engines. The valve has a tubular valve seat support 1, in which a longitudinal bore 3 that is concentric with longitudinal valve axis 2 is formed. An axially movable valve needle 6 is arranged in longitudinal bore 3.

The valve is electromagnetically actuated in a conventional manner. A partially illustrated electromagnetic circuit with a magnet coil 10, a core 11, and an armature 12 is used for axially moving valve needle 6 and thus for opening the valve against the elastic force of a restoring spring 8 and for closing the valve. Valve needle 6 is formed by armature 12, a valve closing body 13, which may be spherical, for example, and a connection piece 14 connecting the two, connection piece 14 having a tubular shape. Restoring spring 8 is supported, at its lower end, by the upper end face of connection piece 14.

Armature 12 is connected to the end of connection piece 14 facing away from valve closing body 13 by a welding seam 15 and aligned with core 11. Valve closing body 13 is also rigidly connected to the end of connection piece 14 facing away from armature 12, for example, by a welding seam 16. Magnet coil 10 surrounds core 11, which represents, by its end surrounding magnet coil 10, a fuel inlet nozzle used for supplying the medium, in this case fuel, to be metered by the valve.

A metallic intermediate part 19 is connected to the lower end of core 11 and to valve seat support 1, concentrically with longitudinal valve axis 2, for example, by welding. A cylindrical valve seat body 25 is tightly attached by welding to the downstream end of valve seat support 1 facing away from core 11 in longitudinal bore 3 that is concentric with longitudinal valve axis 2. Valve seat body 25 has a fixed valve seat 26 facing core 11.

Magnet coil 10 is circumferentially surrounded at least partially by at least one conducting element 30, shaped as a stirrup, for example, which serves as a ferromagnetic element and is in contact, at one end, with core 11 and at the other end with valve seat support 1 and is attached thereto by welding, soldering or gluing.

A guide hole 31 in valve seat body 25 is used to guide valve closing body 13 during its axial movement. Valve seat body 25 is concentrically and rigidly connected, at its lower end face 32, facing away from valve closing body 13, to a perforated spray disk 34, which is cup-shaped, for example. Valve seat body 25 and perforated spray disk 34 are connected, for example, by a circumferential hermetic welding seam 45, formed by a laser, for example. With this type of assembly, the danger of an undesirable deformation of perforated spray disk 34 in the area of its at least one spray hole 46, formed by erosion or punching, for example, is avoided.

The insertion depth of the valve seat parts including valve seat body 25 and perforated spray disk 34 in longitudinal bore 3 determines, among other things, the setting of the lift of valve needle 6, since one end position of valve needle 6 when magnetic coil 10 is not energized is determined by the contact of valve closing body 13 with the surface of valve seat 26 of valve seat body 25. The other end position of valve needle 6 when magnet coil 10 is energized, is determined, for example, by the contact of the upper end face of armature 12 with a lower end face 35 of core 11. The distance between these two end positions of valve needle 6 represents the lift.

Spherical valve closing body 13 interacts with the surface of valve seat 26 of valve seat body 25; the diameter of this surface formed downstream from guide hole 31 of valve seat body 25 becomes conically smaller in the downstream direction. Guide hole 31 has at least one flow opening 27, which allows the medium to flow in the direction of valve seat 26 of valve seat body 25. Flow openings in the form of grooves or flats can also be provided on valve closing body 13.

Figure 2:
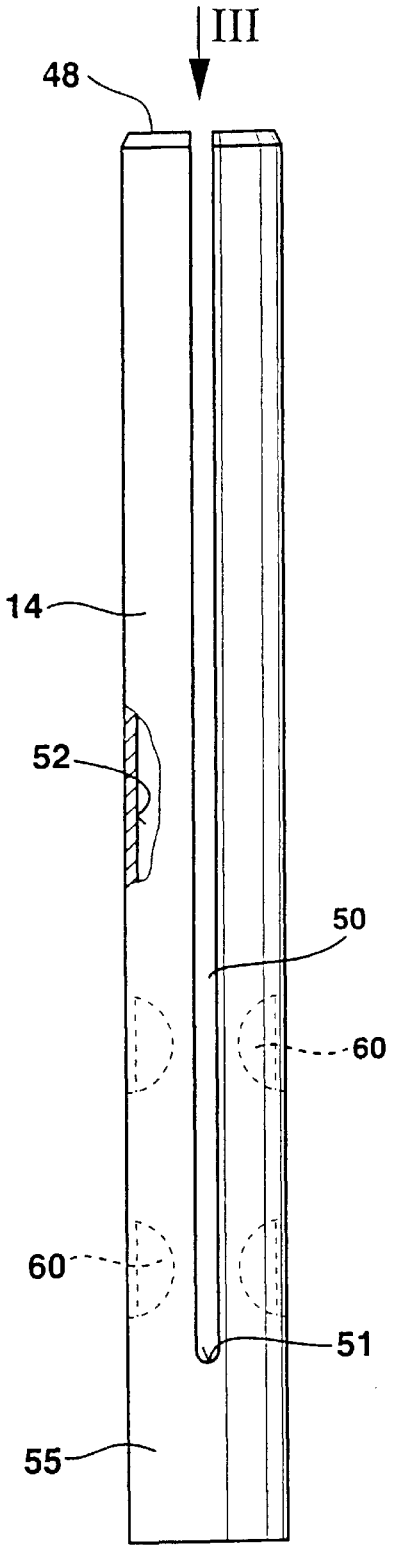
FIG. 2 shows a connection piece of an axially movable valve needle as a single-piece component.
Figure 3:
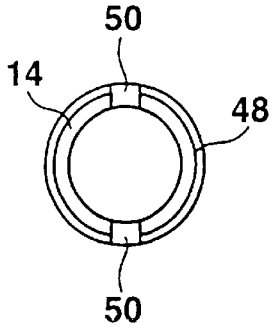
FIG. 3 shows a top view of the connection piece according to FIG. 2.

FIGS. 2 and 3 show connection piece 14 of valve needle 6 according to the present invention, again as a single-piece component prior to achieving rigid connections to armature 12 and valve closing body 13, FIG. 3 being a top view of connection piece 14 at its upstream end on which an annular bevel 48 is formed, for example. In the wall of the tubular or sleeve-shaped connection piece 14, two elongated slots 50 are provided, which completely traverse the wall in the radial direction and do not extend over the entire length of connection piece 14. Instead, slots 50, which are parallel to longitudinal valve axis 2, only extend over the greater portion of the axial length of connection piece 14, specifically over at least 75% of its length, for example, 90% or more. On the connection piece 14 illustrated, the length of the unslotted end 55 downstream of slot end 51 is only about 1 mm, for example, so that the lower pocket hole volume in longitudinal hole 52, facing valve closing body 13, is kept very small.

With the two slots 50, which have a closed downstream end 51 due to their limited length, the fuel flowing into an inner longitudinal opening 52 from core 11 flows to the outside, into longitudinal bore 3 of valve seat support 1. The fuel reaches valve seat 26 and spray holes 46 provided downstream via flow openings 27 in valve seat body 25 or on the periphery of valve closing body 13; the fuel is injected via spray holes 46 into the intake manifold or a cylinder of the internal combustion engine. Slots 50 represent a large-area hydraulic flow cross section, through which the fuel can reach longitudinal bore 3 from internal longitudinal hole 52 very quickly. Thin-walled connection piece 14 provides high stability and minimum weight.

Connection piece 14 can be manufactured by separating individual tubular connection pieces 14 from a commercially available pipe according to the required length and then applying slots 50 in the longitudinal direction from one end, for example, by milling, sawing, laser cutting, or the like.

Figure 4:
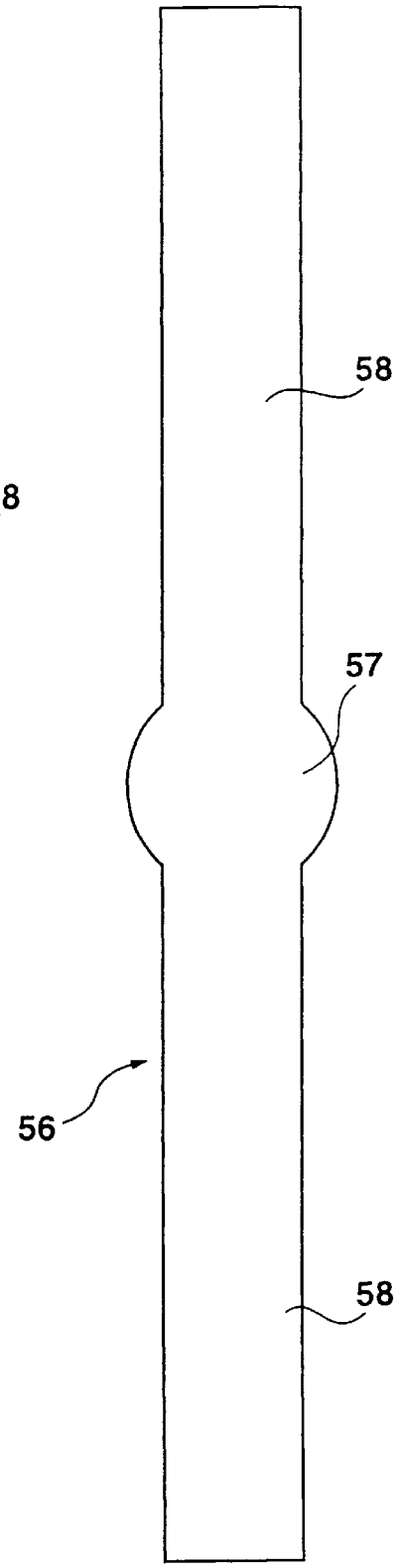
FIG. 4 shows a metal sheet section for forming a connection piece.

Connection pieces 14 can also be manufactured by producing sheet sections 56, such as the one shown in FIG. 4, from a flat metal sheet in a "wristwatch" shape by punching, for example. Sheet section 56 has a central circular region 57, from which two elongated sheet tabs 58 extend in exactly opposite directions. Sheet tabs 58 have a smaller width than the diameter of the central region 57. A punch of a deep-drawing tool (not illustrated) engages first in region 57, deep-drawing it in a bowl shape. By using appropriately shaped punches and dies of the deep-drawing tool, the two tabs 58 are bent 90° in the deep-drawing process in a semi-circular shape, so that they form two elastic half-shells of connection piece 14. Finally, the elongated end faces of the two tabs 58 form the two slots 50 by opposing one another separated by a short distance.

In order to avoid an undesirable effect on the shape of the fuel jet sprayed from spray holes 46 due to the fuel possibly flowing asymmetrically to valve seat 26, connection piece 14 is optionally provided with a plurality of flow openings 60, which go through the walls of both half-shells of connection piece 14. Flow openings 60, which may be circular, for example, and applied by punching, are indicated with dashed lines on connection piece 14 in FIG. 2.

Manufacturing connection piece 14 from a sheet section 56 is a particularly simple process, allowing different materials and mass production methods to be used. By providing slots 50 in connection piece 14, connection piece 14 is spring-elastic on the side facing armature 12, so that relatively great tolerances can be selected for the inside opening of armature 12 and connection piece 14 itself. Due to its spring-elasticity, connection piece 14 with both of its half-shells can be inserted in inside opening of armature 12 under stress. Welding seam 16 can have a very high dynamic strength due to connection piece 14 being in contact with valve closing body 13 along its circumference with its unslotted, non-elastic end 55.

What is claimed is:

1. A process for manufacturing an electromagnetically actuated valve having a longitudinal valve axis, the process comprising a providing core; a magnet coil at least partially surrounding the core; an armature; a valve seat; a valve closing body interacting with the valve seat; and a connection piece connecting the armature and the valve closing body, the connection piece including a wall, two slots penetrating the wall, the two slots extending from a first end face of the connection piece and extending across more than 75% but less than 100% of an axial length of the connection piece;

wherein the connection piece is provided by a step of manufacturing the connection piece from a metal sheet, wherein the connection piece is manufactured from the metal sheet by an initial punching process and a subsequent deep-drawing process.

2. The process according to claim 1, wherein the connection piece is manufactured such that it includes a central circular region, a first sheet tab extending from the central circular region in a first direction, and a second sheet tab extending from the central circular region in a second direction, the second direction being opposite to the first direction, wherein when the connection piece is in an operable configuration the central circular region is formed into a bowl shape and the two sheet tabs extend from the bowl shaped region to form the wall, and wherein elongated end faces of the two sheet tabs oppose one another by a short distance to form the two slots.

3. The process according to claim 1, wherein the punching process comprises punching a sheet section out from a metal sheet, the sheet section having a wristwatch shape, and forming the connection piece from the sheet section.

4. The process according to claim 1, wherein the two slots are manufactured such that a first one of the two slots opposes the other one of the two slots at 180 degrees, the two slots extending parallel to the longitudinal valve axis of the electromagnetically actuated valve.

5. The process according to claim 1, further comprising a step of forming at least one flow-through opening into the wall of the connection piece.

6. The process according to claim 1, further comprising the steps of:

forming the valve closing body such that it has a spherical shape; and connecting the valve closing body to a second unslotted end of the connection piece.

7. The process according to claim 6, wherein the valve closing body is coupled to the connection piece via a rigid connection.

8. The process according to claim 7, wherein the rigid connection is formed by welding a seam extending along 360 degrees of a periphery of the connection piece.

* * * * *